US008413835B2

(12) United States Patent
Flecknoe-Brown

(10) Patent No.: US 8,413,835 B2
(45) Date of Patent: Apr. 9, 2013

(54) CONTAINER ASSEMBLY

(75) Inventor: Anthony Earl Flecknoe-Brown, Yarra Glen (AU)

(73) Assignee: Flextank International Ltd., Victoria (AU)

( * ) Notice: Subject to any disclaimer, the term of this patent is extended or adjusted under 35 U.S.C. 154(b) by 0 days.

(21) Appl. No.: 12/097,566

(22) PCT Filed: Dec. 14, 2006

(86) PCT No.: PCT/AU2006/001896

§ 371 (c)(1),
(2), (4) Date: Sep. 3, 2008

(87) PCT Pub. No.: WO2007/068052

PCT Pub. Date: Jun. 21, 2007

(65) Prior Publication Data

US 2009/0090727 A1 Apr. 9, 2009

(30) Foreign Application Priority Data

Dec. 16, 2005 (AU) ..... 2005907052

(51) Int. Cl.
*B65D 6/40* (2006.01)

(52) U.S. Cl. ..... 220/661; 220/601; 220/403; 222/185.1

(58) Field of Classification Search ..... 220/403, 220/1.5, 661, 601, 668, 9.1, 694, 23.6, 367.1, 220/254.8, 254.1; 206/599, 386; 222/185.1, 222/173

See application file for complete search history.

(56) References Cited

U.S. PATENT DOCUMENTS

| | | | | |
|---|---|---|---|---|
| 4,173,288 | A | 11/1979 | Schutz | |
| 4,432,463 | A * | 2/1984 | MacDonald et al. | 217/12 R |
| 4,648,521 | A | 3/1987 | Thomas et al. | |
| 4,676,373 | A | 6/1987 | Schneider | |

(Continued)

FOREIGN PATENT DOCUMENTS

| | | |
|---|---|---|
| AU | 7158974 A | 1/1976 |
| DE | 2435688 | 2/1975 |

(Continued)

OTHER PUBLICATIONS

Flecknoe-Brown, A, "Oxygen-permeable polyethylene vessels: a new approach to wine maturation," The Australian & New Zealand Grapegrower & Winemaker, Mar. 2005, pp. 53-57.

*Primary Examiner* — Mickey Yu
*Assistant Examiner* — Kareen Rush
(74) *Attorney, Agent, or Firm* — Volpe and Koenig, P.C.

(57) ABSTRACT

A container assembly for controlling rate of oxygen transfer from the atmosphere into a liquid stored in the container assembly comprising, a container (1) having a body, the walls of the body having an oxygen permeability within a predetermined range chosen for the liquid being stored, a frame (2) for supporting the container and bracing at least one of the walls of the container against bulging, a pair of access openings (3) beneath the frame for allowing entry of the tynes of a forklift, a neck (7) with an open mouth extending from an upper wall of the body, the upper wall being shaped so as to allow substantially all air to flow out of the body through the neck as the container is filled to the level of the bottom of the neck and, an outlet (4) for draining liquid from the container arranged near a bottom wall of the body.

10 Claims, 4 Drawing Sheets

U.S. PATENT DOCUMENTS 4,850,506 A * 7/1989 Heaps et al. ..... 229/117.3
4,884,713 A * 12/1989 Handler ..... 220/23.4
5,058,747 A 10/1991 Decroix et al.
5,507,392 A * 4/1996 Schutz ..... 206/600
5,515,991 A * 5/1996 Heitland ..... 220/256.1
5,649,640 A * 7/1997 Hermann et al. ..... 220/1.5
5,680,955 A * 10/1997 Schutz ..... 220/1.6
5,893,489 A * 4/1999 Giarrante ..... 222/482
6,050,538 A 4/2000 Marrow et al.
6,390,331 B2 * 5/2002 Schutz ..... 222/105
2007/0128387 A1 * 6/2007 Unwin et al. ..... 428/35.7

FOREIGN PATENT DOCUMENTS

JP 2000025781 A 1/2000
JP 2001114295 A 4/2001
JP 2003176190 A 6/2003
RU 2071258 C1 1/1997
WO 0128889 A1 4/2001
WO 03016177 A1 2/2003
WO 2005052114 A1 6/2005

* cited by examiner

CONTAINER ASSEMBLY

FIELD OF THE INVENTION

The invention relates to a container assembly. It relates particularly but not exclusively to a container assembly for maturing wine which includes means for facilitating handling by a forklift truck.

BACKGROUND OF THE INVENTION

International application, now published as WO 2005/052114 A1 (herein incorporated by reference) describes a container assembly for controlling the rate of oxygen transfer from the atmosphere into a liquid stored in the container comprising:

- a container with an oxygen permeability of 50 ml to 300 ml of oxygen per square meter of area of wall, for each 1 mm of thickness of said wall, per 24 hour period at room temperature,
- a floating barrier member for providing a permeable barrier to limit oxygen access from the head space in the container to the surface of the liquid.

Whilst the container assembly described in that application is effective for certain requirements, there is a range of additional requirements which need to be met by developing the basic concept of the original invention further. These include:

- increasing the maximum volume, whilst maintaining the correct relationship between surface area of the container and the volume within it,
- supporting the polyethylene container, so that its shape is maintained,
- elevating the vessel off the ground,
- allowing all of the contents to be fully drained through the floor,
- allowing the vessel to be lifted and tipped to empty solids components of the contents, by means of a forklift with a rotating head,
- safely stacking the filled vessels vertically,
- removing the requirement for a floating barrier member when the vessel is filled,
- providing a convenient means to add and remove oak wood.

Accordingly the following is a description of an invention which facilitates one or more of these improvements.

DISCLOSURE OF THE INVENTION

The invention provides a container assembly for controlling rate of oxygen transfer from the atmosphere into a liquid stored in the container assembly comprising,

- a container having a body, the walls of the body having an oxygen permeability within a predetermined range chosen for the liquid being stored,
- a frame for supporting the container and bracing at least one of the walls of the container against bulging,
- access opening beneath the frame for allowing entry of the tynes of a forklift,
- a neck with an open mouth extending from an upper wall of the body, the upper wall being shaped so as to allow all air to flow out of the body through the neck as the container is filled to the level of the bottom of the neck and,
- an outlet for draining liquid from the container arranged near a bottom wall of the body.

The outlet may comprise a tap or valve. It may be provided at a bottom wall of the container. The bottom wall of the container may slope downwardly towards the outlet to allow substantially all liquid in the container to drain through the outlet when it is opened.

The outlet may be located in a recess of a side wall of the container. The recess may be joined to the side wall by radiused portions which have a radius larger than the depth of the recess. The bottom wall may have a dip at the join with the recess.

A barrier member may be provided in association with the container contents. The barrier member may be arranged to float on the surface of liquid in the body of the container or liquid in the neck of the container. The barrier member may have a peripheral portion which is in sliding contact with the walls of the container so as to separate the liquid surface from the container headspace or neck headspace.

The barrier member may comprise a core of low density material overwrapped and sealed within a plastic film. The plastic film may extend beyond the low density material to form a flexible lip which may abut the sides of the body of the container or the neck to reduce contact with gas in the headspace.

The low density material may comprise a rigid or flexible plastic foam.

The film covering the upper surface of the low density material may be provided with a sealable vent to reduce gas pressure bulging of film with respect to the plastic foam.

Where the container is being used to mature wine, it may comprise a rigid plastics material which allows oxygen to permeate the walls directly from the atmosphere into the liquid in contact with the walls, the rigid plastics material having a permeability measured at a rate of 13 mg to 65 mg of atmospheric oxygen per square meter as measured for a 1 mm thickness during a 24 hour period at room temperature.

In one embodiment, the container assembly may be configured so that the assemblies can be stacked one atop the other.

Preferred aspects of the invention will now be described with reference to the accompanying drawings.

DETAILED DESCRIPTION OF THE PREFERRED EMBODIMENTS

Figures 1, 1A, 1B:
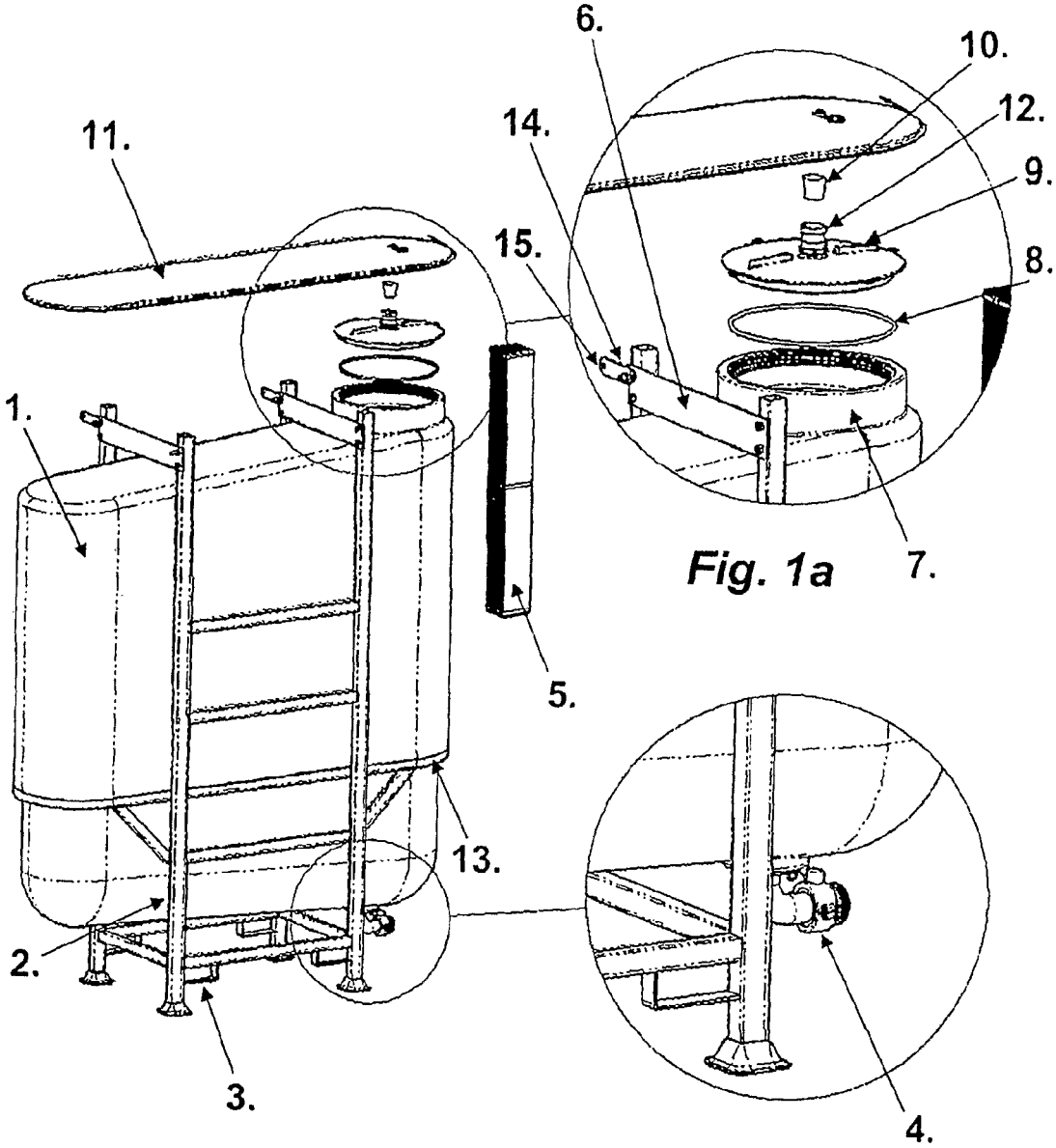
FIG. 1 shows an isometric view with partially exploded elements of a container assembly according to the invention.
FIG. 1*a* shows an enlarged view of a circled portion of FIG. 1.
FIG. 1*b* shows an enlarged view of another circled portion of FIG. 1.
Figures 2, 2A, 2B:
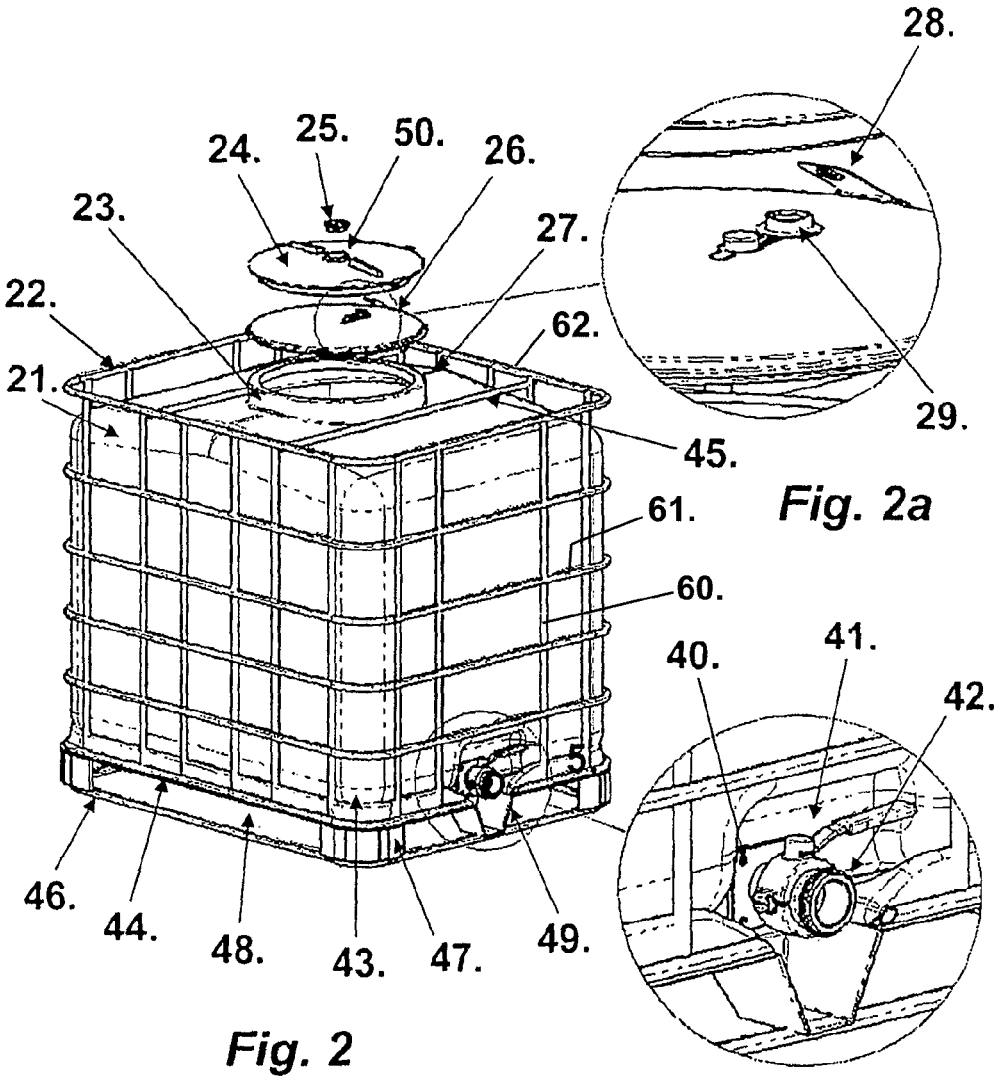
FIG. 2 shows an isometric view of an alternative container assembly according to the invention.
FIG. 2*a* shows an enlarged view of a circled section of FIG. 2.
FIG. 2*b* shows an enlarged view of a circled section of FIG. 2.
Figure 3:
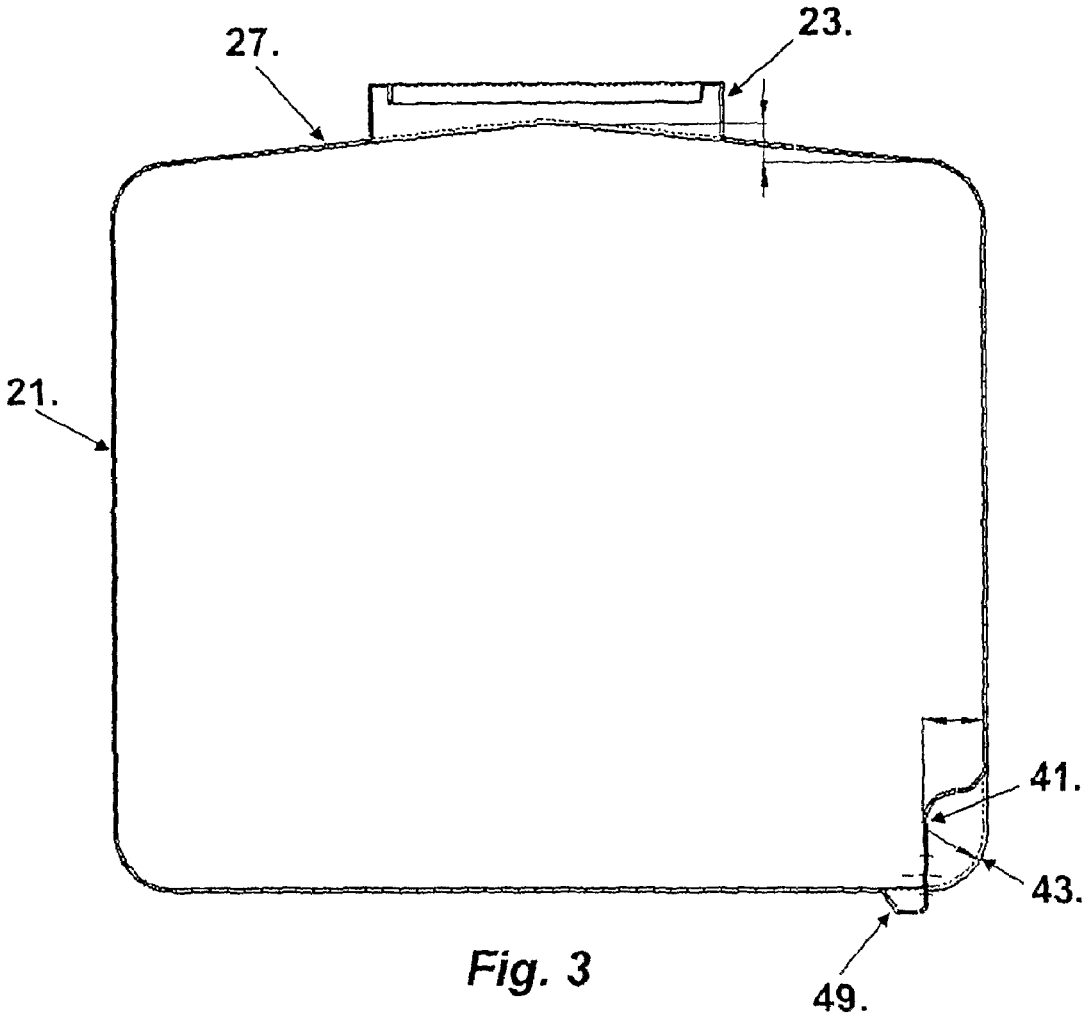
FIG. 3 shows a cross-section taken through the container of FIG. 2.

The various elements identified by numerals in the drawings are listed in the following integer list.

Integer List

1 Container
2 Frame
3 Loop

4 Base valve
5 Oak staves
6 Removable cross member
7 Neck
8 Seal ring
9 Screw lid
10 Rubber bung
11 Variable capacity insert blocking surface
12 Second cylinder
13 Step
14 Locking link
15 Hole
21 PE container
22 External frame
23 Neck
24 Screw lid
25 Screw plug
26 Floating element
27 Roof
28 Tag
29 Valve
31 Foamed core
32 Polyurethane film
33 Wine
34 Peripheral flange
35 Wall
37 Hole
40 Hole
41 Recess
42 Valve
43 Radius
44 Sheet metal base
45 Removable cross member
46 Bottom ring
47 Pillar
48 Openings
49 Dip
50 Opening One embodiment of the apparatus of our invention is illustrated in FIGS. 1, 1*a* and 1*b*, herein. This shown as an optionally thermally insulated polyethylene container of a non-round, preferably flat-sided shape with an opening in the top defined by a round neck (7) forming part of the tank, which has an internal (or external) screw thread incorporated within it.

This inner container is then fitted within a metal or plastic composite external frame (2) which, by being in close contact with the walls and engaging on a step in the container wall (13), supports the weight of the contents and prevents the hydrostatic pressure from excessively bulging the flat side walls of the inner container.

The upper wall of the inner container slopes upwardly towards the neck (7) to allow air to flow out of the body of the container through the neck as it is filled.

The vertical pillars of the frame of this embodiment are open at both the top and the to bottom. A removable top cross member 6 allows the container (1) to be fitted into the rigid frame (2) and is used to restrain each pair of opposed vertical members against the bulge of the vessel under hydrostatic load. This cross member is optionally fitted with upwards projection which can fit into vertical members of another identical vessel stacked on it. By this means the composite vessels can be safely stacked one on the other.

To render the lower vessels more stable, when upper vessels are to be stacked upon them, a side locking link (14) is fitted to two of the adjacent opposite uprights. A hole (15) is drilled in the other end of each link. A second identical tank is to be positioned closely beside the first. Subsequently the link of one vertical member is bolted to the vertical member of the next frame.

The rigid frame (2) is optionally fitted with restraining loops (3) or additional cross members that will engage with and trap the tines of a forklift truck. By this means the tank can be picked up and moved safely. If the forklift truck is fitted with a rotating head, the vessel may also be tipped in a manner similar to a "Jerry Can" so that the contents within can be freely discharged through the open neck (7). This enables any solids component in the stored liquid to be easily discharged. Such solid components arise, for example, when red wine is fermented in the vessels and may comprise the skins of the grape and/or the settled yeast lees.

In this embodiment a screw lid (9) can be screwed into the neck (7) and sealed by means of an additional seal ring (8), preferably made of compliant material. The lid is also fitted with a vent in the form of a second cylinder (12) optionally also fitted with an internal or external screw thread.

The tank can be filled into the second small cylinder (12) which can then be sealed by means of a silicone or rubber bung (10), a vented rubber bung (to allow gas to escape from the contents) or a vented or non-vented screw closure or openable valve or especially a one way valve.

An optional base valve (4) is fitted through the bottom wall forming the base of the tank so as to enable bottom filling or discharge of the tank contents without disturbing sediment that may have settled to the bottom the tank. The bottom wall may slope downwardly to the base valve to facilitate drainage. Where the liquid in the container is wine the walls of the container (1) neck cylinder (7) and screw lid (9) are made from polyethylene preferably with an oxygen permeability in the range between 50 to 300 ml of oxygen per sqm of tank surface per 24 hr per atm for each 1 mm of tank wall thickness at typical storage temperatures of 20-25° C.

The ratio of contained volume to surface area of said container preferably falls within the range 5 to 30 liters per square meter of surface for each 1 mm of thickness, to ensure that an adequate rate of permeation of oxygen is maintained for maturation of wine. Different ratios may apply where other liquids are being matured.

In this embodiment, a pre-assembled pack of oak wood staves (5) of the desired number, variety and degree of toast is lowered into wine within the tank. That may be fitted with a cord which has a float at the loose end, so that the pack can be retrieved after it has become spent, ie. has given up most of its oak flavour and has become soaked through with liquid, usually sinking.

Figure 4:
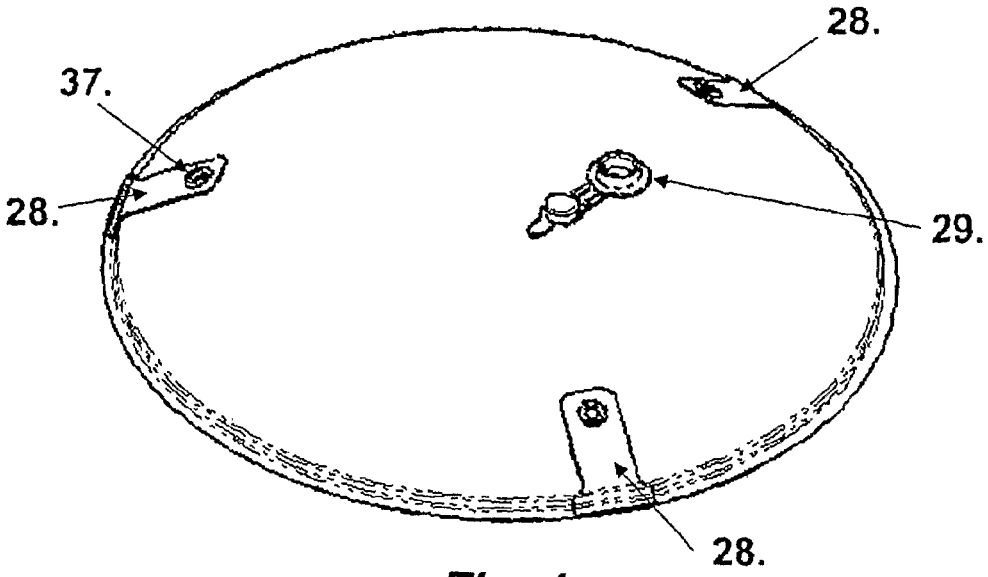
FIG. 4 shows an isometric view of a floating element.
Figure 5:
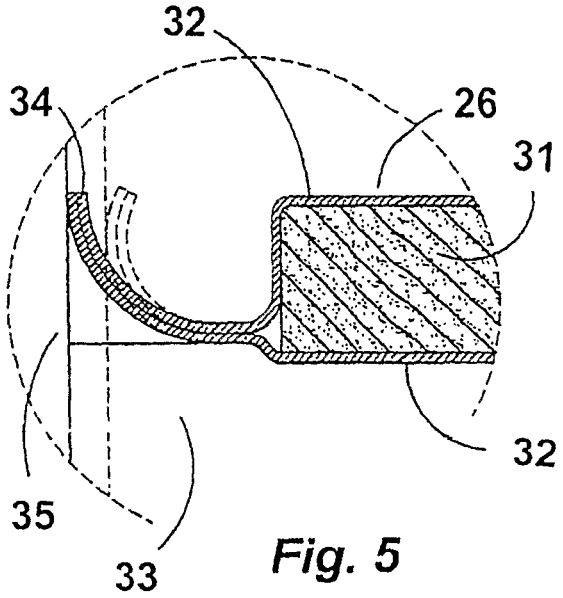
FIG. 5 shows the cross-section Z-Z taken through the floating element of FIG. 4.

Should it be desired to partially fill the vessel, a flexible floating element, as described in WO 2005/052114 A1 shaped to match the internal shape of the vessel, can be introduced through the open neck (7). This element will block most of the free surface area of the contained liquid. At any level of fill within the main body of the vessel, the use of this element enables the stored liquid to see approximately the same amount of oxygen per liter though that part of the walls in contact with the liquid, as well as that area in contact with the floating element. One form of such an element is shown in FIGS. 4 and 5.

Referring to FIGS. 2, 2*a*, 2*b* and 3 to 5, there is shown a container assembly according to the invention which comprises an optionally thermally insulated polyethylene container (21) of a flat-sided shape with an opening in the top defined by a neck (23) in the form of a cylinder extending from a top wall of the container. The neck has an internal (or external) screw thread.

This container is then fitted within a metal external frame (22) which includes a substantially flat sheet metal base (44). The cage supports the weight of the contents and is made up of interlocked vertical (60) and horizontal (60) steel tubes. By being in close contact with the walls of the inner container, the cage prevents the hydrostatic pressure from excessively bulging the flat side walls of that inner container.

The vertical pillars of the cage of this embodiment are closed at both the top and the bottom. Removable top cross members (45) allow access for the container (21) to be fitted into the rigid frame (22) and are used to restrain each pair of opposed vertical members against the bulge of the vessel under hydrostatic load, as well as to retain the inner container when the tank is tipped.

The sheet metal base (44) is sized and shaped to nest into the top ring (62) of the cage on a lower container assembly when stacked on it. By this means the container assemblies can be retained sidewise and thus safely stacked one on the other.

The rigid frame (22) extends downwardly past the sheet metal base (44) and is closed with a bottom ring (46) spaced from the base (44) by the pillars (47). That provides access for the tines of a forklift truck through opening (48). By this means the tank can be picked up and moved. If the forklift truck is fitted with a rotating head, the vessel may also be tipped upside down to discharge through the neck (23). This enables any solids component in the stored liquid to be easily discharged. Such solid components arise, for example, when red wine is fermented in the vessels and may comprise the skins of the grape and/or the settled yeast lees.

In this embodiment, a screw lid (24) can be screwed into the neck (23) and sealed by means of an additional seal ring (not shown), preferably made of compliant material. The lid is also fitted with a screw threaded centre opening (50). The opening is optionally closed with a screw plug (25) or fitted with other fittings such as a riser tube with a cap (not shown), a check valve for the venting off of ferment gas, or a hose tail (not shown), to which may be attached the delivery side of a pump that has the suction side attached to an optional base valve (43), enabling the pumping over the liquid contents.

The container (21) and neck (23) are to be made from polyethylene (such as rotationally moulded polyethylene) with an oxygen permeability in the range between 50 to 300 ml of oxygen per sqm of tank surface per 24 hr per atm per 1 mm of tank wall thickness at typical storage temperatures 20-25° C. When the thickness of the tank wall is doubled, it is to be noted that the rate of oxygen transmission per unit of surface area is halved.

The ratio of contained volume to surface area of said container is to fall within the range 5 to 30 liters per square meter of surface for each 1 mm of thickness, to ensure that an adequate rate of permeation of oxygen is maintained for maturation of wine. Different rates may apply where other liquids are being matured.

Unless a riser tube and cap is added to the screw lid (24) and the wine filled into it, a vessel of this relatively small volume, if filled up into the neck, has a relatively high exposed surface area of wine for the volume. Thus it will be desirable to fit the flexible floating element (26) which acts as a barrier member as described in WO 2005/052114 A1 sized to match the internal size of the neck (23).

The floating element (26) has a foamed plastic core (31) which floats on top of the wine in the neck of the container. The foamed plastic core (31) is overwrapped with a polyurethane film overwrap (32) which comprises two separate layers covering the top and bottom of the foamed plastic core. These two separate layers are laminated together at their edges to form the peripheral flange (34). The peripheral flange provides a slidable seal with the wall (35) of the neck so as to substantially reduce the rate of oxygen transfer from the head space of the neck through the surface of the wine and hence limits the growth of undesirable aerobic bacteria.

The floating element is provide with three tags (28) distributed around its upper surface, each of the tags being formed with a hole or loop (37). The tags assist with allowing the barrier member to be correctly located in the neck in contact with the wine (33) initially and to be removed after the container has been emptied.

To reduce oxygen entry it is possible to add carbon dioxide ($CO_2$) gas to the head space above the floating element. That renders the partial pressure of $CO_2$ near to 1 atmosphere in the head space of the tank, far higher than in air (less than 0.05 atm). Over time this $CO_2$ gas, which diffuses through polymeric material about 4 to 8 times faster than oxygen and about 12 to 20 times faster than Nitrogen permeates into and can inflate the floating element causing it to bulge at the centre and thus to lift off the wine surface around the edges.

This can come about because $CO_2$ permeates through and enters the interior of the insert at a far higher rate than the rate at which the initial oxygen and nitrogen within the sealed element can leave. Hence the total pressure in the interior of the element rises and cause it to become inflated. The addition of a valve (29) is thus desirable for the correct long term functioning of these floating elements.

In use, the valve is left open after the floating element is inserted, so that the internal and external pressure remains balanced and the element prevented from inflating. The valve needs to be re-closeable so that the element can be closed up for washing off after use without wash water entering the interior. The valve also usually needs to be closed during insertion of the element into a tank, to prevent any wine that may be "scooped" up onto the top of the element from entering the interior of that element where it will spoil.

Where the barrier element is to be fitted in the body of the container rather than the neck, it is noted that the element comprising the foamed plastic core and polyurethane film overlap may suitably be formed of flexible materials in order to allow it to be folded so that it may be inserted through the neck of the container during initial setup and to be removed through the neck when the container is emptied.

In this embodiment, there are certain important geometric features that are desirable to enable the tank to function correctly for wine storage use. The upper wall forming the roof (27) of the tank (21) rises from its outer edges towards the manhole neck (23) so that as the tank is filled, substantially all of the head space air above the wine can be discharged through the neck.

To ensure that the contents of the tank can be substantially fully discharged, a further geometric preferment is that the radius (43) between the side walls and the recess is to be larger than the depth of the recess (41) in which the valve (42) is mounted. Furthermore, a dip (49) is formed in the bottom wall adjoining the recess. In this embodiment, the valve (42) is attached to the flat face of the recess (41) by round-head coach bolts encapsulated into the polyethylene (not shown). These are directed through three or more holes (40) in the valve flange and clamped by nuts (also not shown).

Oak-wood staves of the desired number, variety and degree of toast can be lowered into wine within the tank. That may be fitted with a cord which has a float at the loose end, so that the pack can be retrieved after it has become spent, ie. has given up most of its oak flavour and has become soaked through with liquid usually sinking.

The container of this invention can optionally be used to mature a wide range of different wines, spirits or other liquid foods, such as "Tabasco" or other foods or non-foods that may benefit from exposure over time to a controlled amount of oxygen.

Whilst the above description includes the preferred embodiments of the invention, it is to be understood that many variations, alterations, modifications and/or additions may be introduced into the constructions and arrangements of parts previously described without departing from the essential features or the spirit or ambit of the invention.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features.

The reference to any prior art in this specification is not, and should not be taken as, to an acknowledgment or any form of suggestion that such prior art forms part of the common general knowledge in Australia.

The invention claimed is:

1. A container assembly for maturing wine in bulk, the container assembly comprising, a container having a body with upper, side and bottom walls, a frame for supporting the container and bracing at least one side wall of the container against bulging, an access opening beneath the frame for allowing entry of the tynes of a forklift, a neck with an open mouth extending from an upper wall of the body, the upper wall slopes upwardly towards the neck to allow substantially all air to flow out of the body through the neck as the container is filled to the level of the bottom of the neck and, an outlet for draining liquid from the container arranged proximate a dip formed in the bottom wall of the body, wherein the body comprises rigid polyethylene with walls having an oxygen transmission rate suitable for maturing wine stored in the container assembly, of 13 mg to 65 mg of atmospheric oxygen per square meter as measured for a 1 mm thickness during a 24 hour period at room temperature and wherein the rigid bottom wall is sloped towards the outlet to allow substantially all liquid in the container to drain through the outlet when it is opened.

2. The container assembly of claim 1 wherein the outlet is located in a recess of a side wall of the container proximate a bottom wall of the container.

3. The container assembly of claim 1 wherein the neck is sealed with a closure having a vent.

4. The container assembly according to claim 3 wherein the closure and neck comprise co-operating screw threads for allowing the closure to be screwed onto the neck.

5. The container assembly of claim 1 comprising a barrier member adapted to float on the surface of the liquid in the body of the container, the barrier member having a peripheral portion which is in sliding contact with the walls of the container so as to separate the liquid surface from the container head space.

6. The container assembly of claim 1 comprising a barrier member adapted to float on the surface of the liquid in the neck of the container, the barrier member having a peripheral portion which is in sliding contact with the walls of the container so as to separate the liquid surface from head space in the neck.

7. The container assembly according to claim 5 wherein the barrier member comprises a core of low density material overwrapped and sealed within a plastics film which extends beyond the low density material to form a flexible lip.

8. The container assembly according to claim 7 wherein the low density material comprises flexible plastic foam.

9. The container assembly according to claim 7 comprising a sealable vent provided on the film covering an upper surface of the low density material.

10. The container assembly of claim 1 wherein the frame comprises a substantially flat base, and a cage formed of interlocked tubes extends form the perimeter of the flat base to a top ring, and the base is sized and shaped to nest into the top ring of a cage on a container assembly of similar construction whereby to facilitate stacking of container assemblies, one atop the other.

* * * * *

UNITED STATES PATENT AND TRADEMARK OFFICE

CERTIFICATE OF CORRECTION

PATENT NO. : 8,413,835 B2
APPLICATION NO. : 12/097566
DATED : April 9, 2013
INVENTOR(S) : Anthony Earl Flecknoe-Brown It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 362 days.

Signed and Sealed this
Twenty-fifth Day of June, 2013

Teresa Stanek Rea
*Acting Director of the United States Patent and Trademark Office*